US010663250B1

(12) United States Patent
Kung et al.

(10) Patent No.: US 10,663,250 B1
(45) Date of Patent: May 26, 2020

(54) EMPTY-MAGAZINE POWER-OFF STRUCTURE OF ELECTRIC TOY GUN

(71) Applicant: VEGA FORCE INTERNATIONAL CORP., Taoyuan (TW)

(72) Inventors: Shih-Che Kung, Taoyuan (TW); Wei-Hung Chung, Taoyuan (TW)

(73) Assignee: VEGA FORCE INTERNATIONAL CORP., Taoyuan (TW)

( * ) Notice: Subject to any disclaimer, the term of this patent is extended or adjusted under 35 U.S.C. 154(b) by 0 days.

(21) Appl. No.: 16/524,006

(22) Filed: Jul. 27, 2019

(30) Foreign Application Priority Data

Dec. 4, 2018 (TW) ..... 107216452 U

(51) Int. Cl.
*F41B 11/50* (2013.01)
*F41B 11/70* (2013.01)
*F41B 11/71* (2013.01)
*F41B 11/57* (2013.01)

(52) U.S. Cl.
CPC ..... *F41B 11/57* (2013.01); *F41B 11/50* (2013.01)

(58) Field of Classification Search
CPC .. F41B 6/00; F41B 11/57; F41B 11/50; F41B 11/51; F41B 11/52; F41B 11/53
USPC ..... 124/73, 45
See application file for complete search history.

(56) References Cited

U.S. PATENT DOCUMENTS

2007/0000483 A1* 1/2007 Tsurumoto ..... F41A 17/36 124/73
2009/0253103 A1* 10/2009 Hogan, Jr. ..... F41A 9/61 434/24
2015/0241164 A1* 8/2015 Hsu ..... F41B 11/55 124/51.1

* cited by examiner

*Primary Examiner* — John E Simms, Jr.
(74) *Attorney, Agent, or Firm* — Chun-Ming Shih; HDLS IPR Services

(57) ABSTRACT

An empty-magazine power-off structure of electric toy gun includes a bore component and a power source switch; the bore component has a ball firing pipe and a ball feeding pipe connected to the ball firing pipe, a ball chamber is formed in the ball firing pipe, and the ball feeding pipe has a ball guiding channel communicated with the ball chamber from an external side; the power source switch is relatively disposed at an outer side of the ball feeding pipe, and at least has one trigger part protruded into the ball guiding channel. As such, when a bullet ball in the magazine passes the ball guiding channel, the bullet ball is able to press the power source switch to determine whether any bullet ball remains in the magazine.

6 Claims, 6 Drawing Sheets

EMPTY-MAGAZINE POWER-OFF STRUCTURE OF ELECTRIC TOY GUN

BACKGROUND OF THE INVENTION

Field of the Invention

The present invention relates to a toy gun, especially to an empty-magazine power-off structure of electric toy gun.

Description of Related Art

A conventional toy gun mainly utilizes a driving means, for example gas or electric driving means, to achieve a bullet ball firing effect. Wherein, a toy gun adopting electricity as a driving means is the most popular in the market.

In an electricity-driven toy gun, a firing unit composed of components, for example a piston, is driven by a motor and a gear set thereof, so that a bullet ball can be fired via an air pressure so as to simulate a firing effect of a real gun; meanwhile, when there is no bullet ball in the magazine, a sensing means is adopted for informing there is no bullet ball remaining in the magazine, so that the power source is cut off for not allowing the motor to perform a driving operation so as to simulate a firing feeling of the real gun with an empty magazine. However, the conventional sensing or simulating means is overly complicated in structure and occupies a lot of space. As such, the above-mentioned disadvantages shall be improved.

Accordingly, the applicant of the present invention has devoted himself for improving the mentioned disadvantages.

SUMMARY OF THE INVENTION

The present invention is to provide an empty-magazine power-off structure of electric toy gun, which is disposed in a path of a bullet ball travelling from a magazine to a ball chamber of an electric toy gun structure, so that there is no additional spaced occupied in the conventional electric toy gun, the appearance and the design of the toy gun can still follow a real gun as a model, the cost of components can be lowered, and the firing feeling provided to the user when the toy gun is in an empty-magazine power-off status can still be remained.

The present invention is to provide an empty-magazine power-off structure of electric toy gun, in which switches of a plurality of trigger parts or a plurality of switches can be continuously disposed according to a travelling length, and an effect and an objective of precisely determining a remaining amount of bullet balls in a magazine can be achieved.

Accordingly, the present invention provides an empty-magazine power-off structure of electric toy gun, which includes a bore component and a power source switch; the bore component has a ball firing pipe and a ball feeding pipe connected to the ball firing pipe, a ball chamber is formed in the ball firing pipe, and the ball feeding pipe has a ball guiding channel communicated with the ball chamber from an external side; the power source switch is relatively disposed at an outer side of the ball feeding pipe, and the power source switch at least has one trigger part protruded into the ball guiding channel. As such, when a bullet ball in the magazine passes the ball guiding channel, the bullet ball is able to press the power source switch to determine whether any bullet ball remains in the magazine.

Accordingly, the present invention provides an empty-magazine power-off structure of electric toy gun, in which when a bullet ball passes a ball guiding channel, only one of plural trigger parts is pressed by the bullet ball at the same time. As such, the plural trigger parts are sequentially pressed by the passing bullet ball, and signals generated by being alternatively pressed can be utilized for further determining the bullet ball in a magazine being in an operated status or a fired status.

DETAILED DESCRIPTION OF THE INVENTION

A preferred embodiment of the present invention will be described with reference to the drawings.

Figure 1:
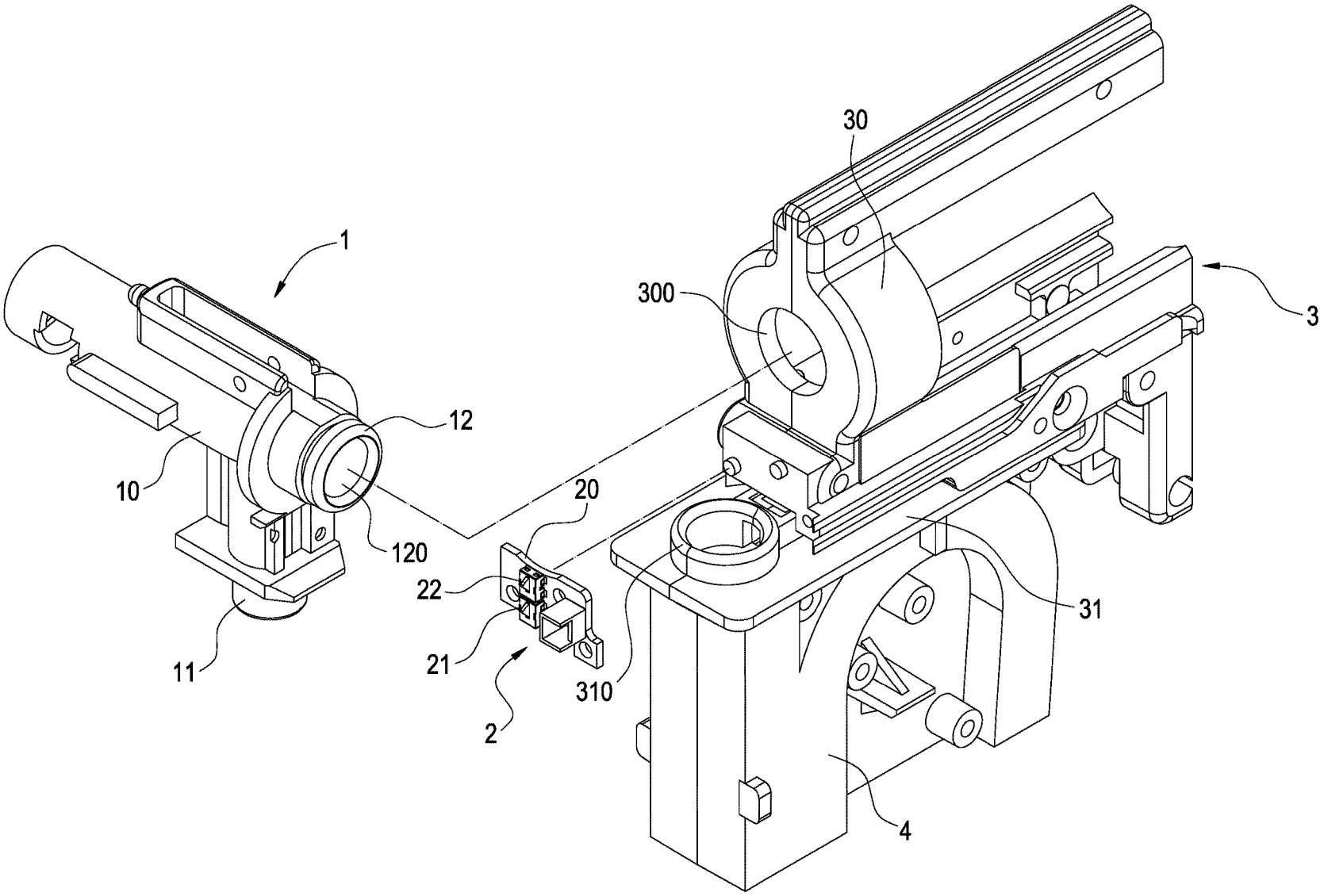
FIG. 1 is a perspective exploded view according to the present invention.
Figure 2:
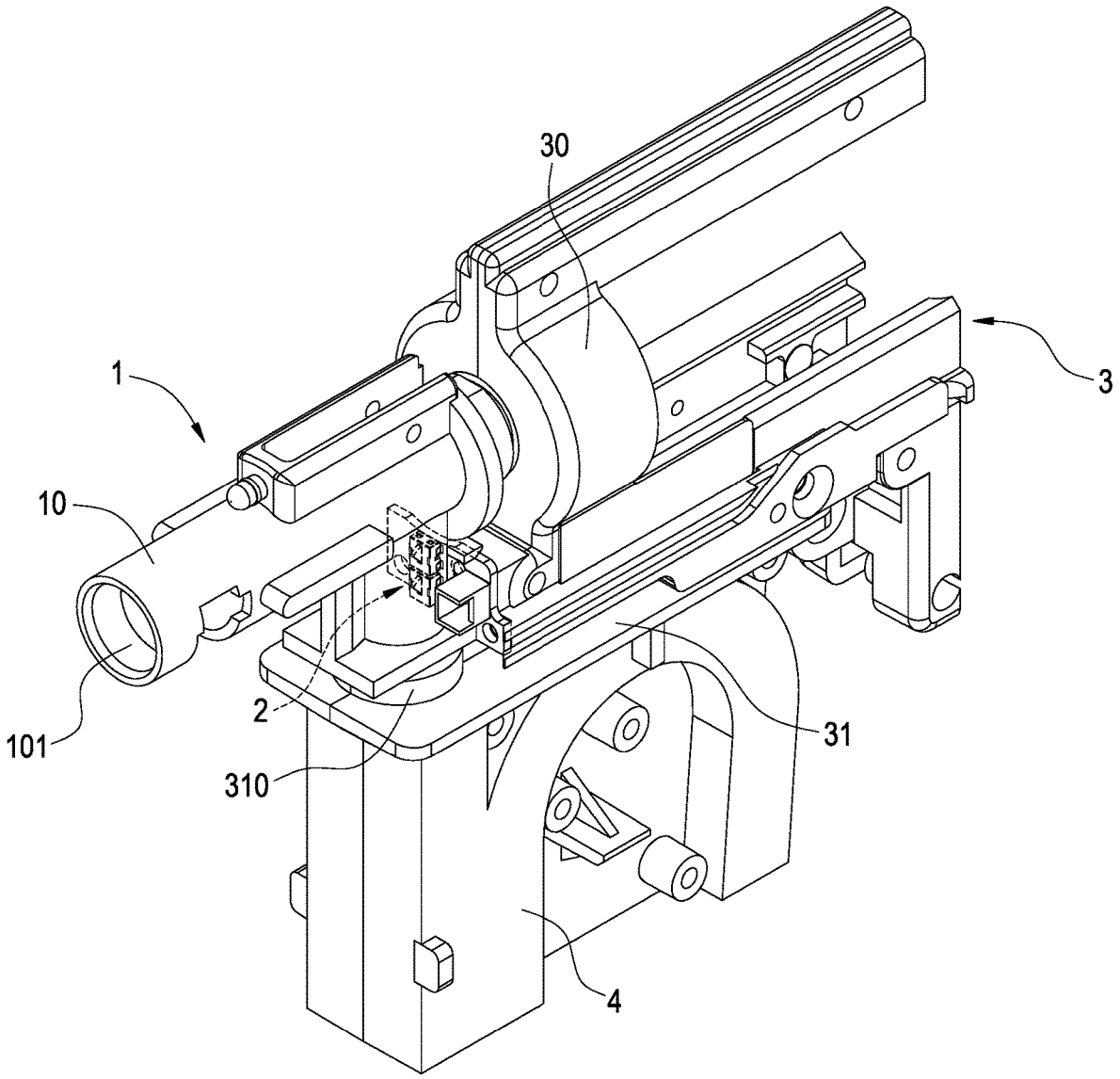
FIG. 2 is a perspective view showing the assembly according to the present invention.
Figure 3:
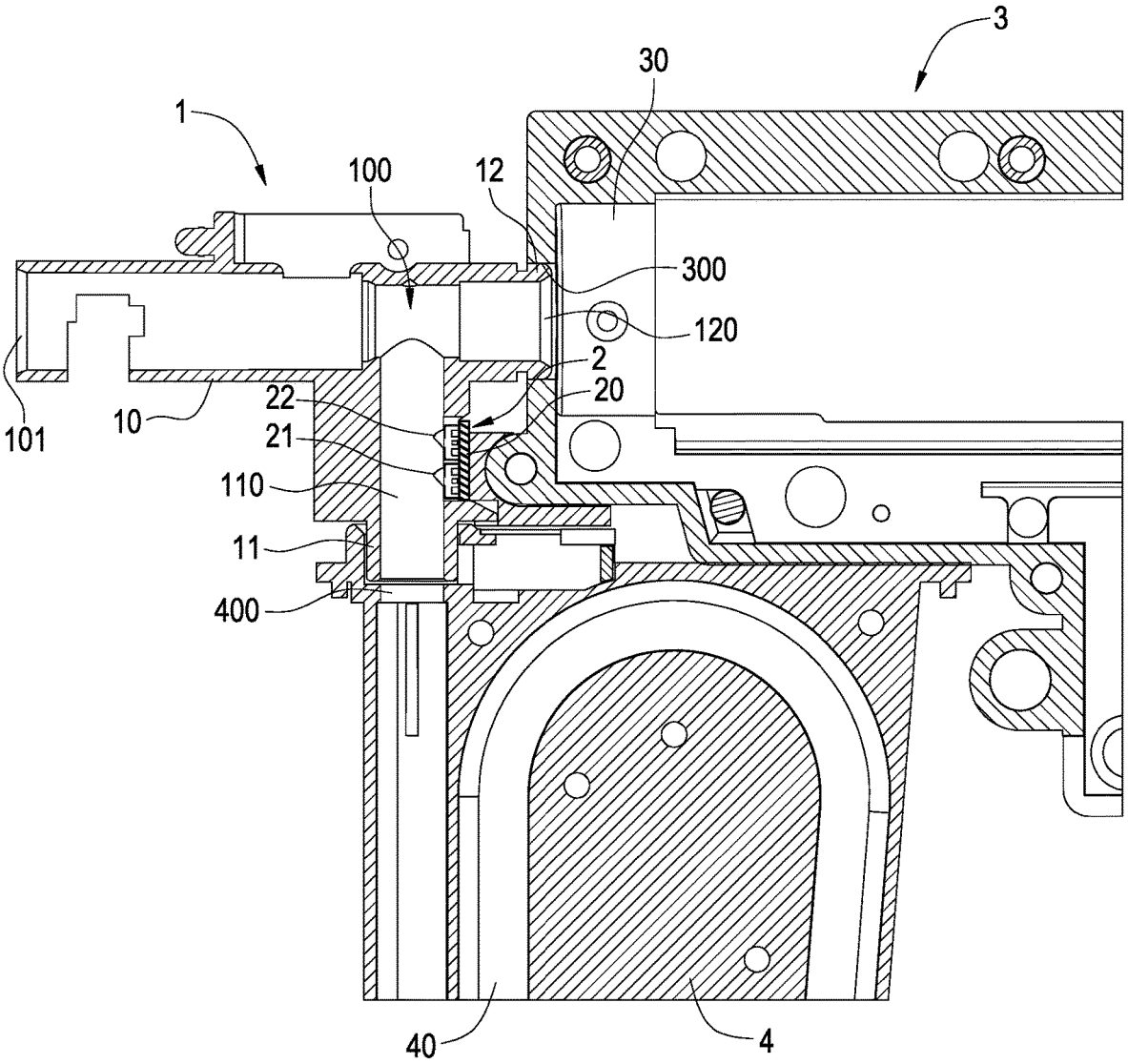
FIG. 3 is a cross sectional view showing the assembly according to the present invention.

Please refer from FIG. 1 to FIG. 3, wherein FIG. 1 is a perspective exploded view according to the present invention; FIG. 2 is a perspective view showing the assembly according to the present invention; and FIG. 3 is a cross sectional view showing the assembly according to the present invention. The present invention provides an empty-magazine power-off structure of electric toy gun, which is used to be disposed in an electric toy gun or served as a component of the electric toy gun. The electric toy gun is driven by a motor and includes a bore component 1 and a power source switch 2 for controlling the motor to be operated or stopped.

The bore component 1 is used to be connected between a gun barrel and a fire unit (i.e. a locking of a real gun). Moreover, the fire unit is disposed on a gun body rear base 3 (not shown in figures), in other words the gun body rear base 3 has a fastening seat 30 allowing the fire unit to be disposed. Furthermore, a magazine 4 is assembled and disposed at a bottom end of the gun body rear base 3.

Based on what has been disclosed above, the bore component 1 has a ball firing pipe 10 and a ball feeding pipe 11 connected to the ball firing pipe 10. As shown in FIG. 3, a ball chamber 100 is formed in the ball firing pipe 10, and the ball chamber 100 is connected to the magazine 4 via the ball feeding pipe 11. A ball storing channel 40 is formed in the magazine 4, and the ball storing channel 40 is formed with an opening 400 at a location defined at a top end of the magazine 4. When the magazine 4 is assembled at the bottom end of the gun body rear base 3, the opening 400 is able to be connected to the ball feeding pipe 11. A firing port 101 communicated with the ball chamber 100 is formed at a front end of the ball firing pipe 10 so as to be further connected with a gun barrel.

Figure 4:
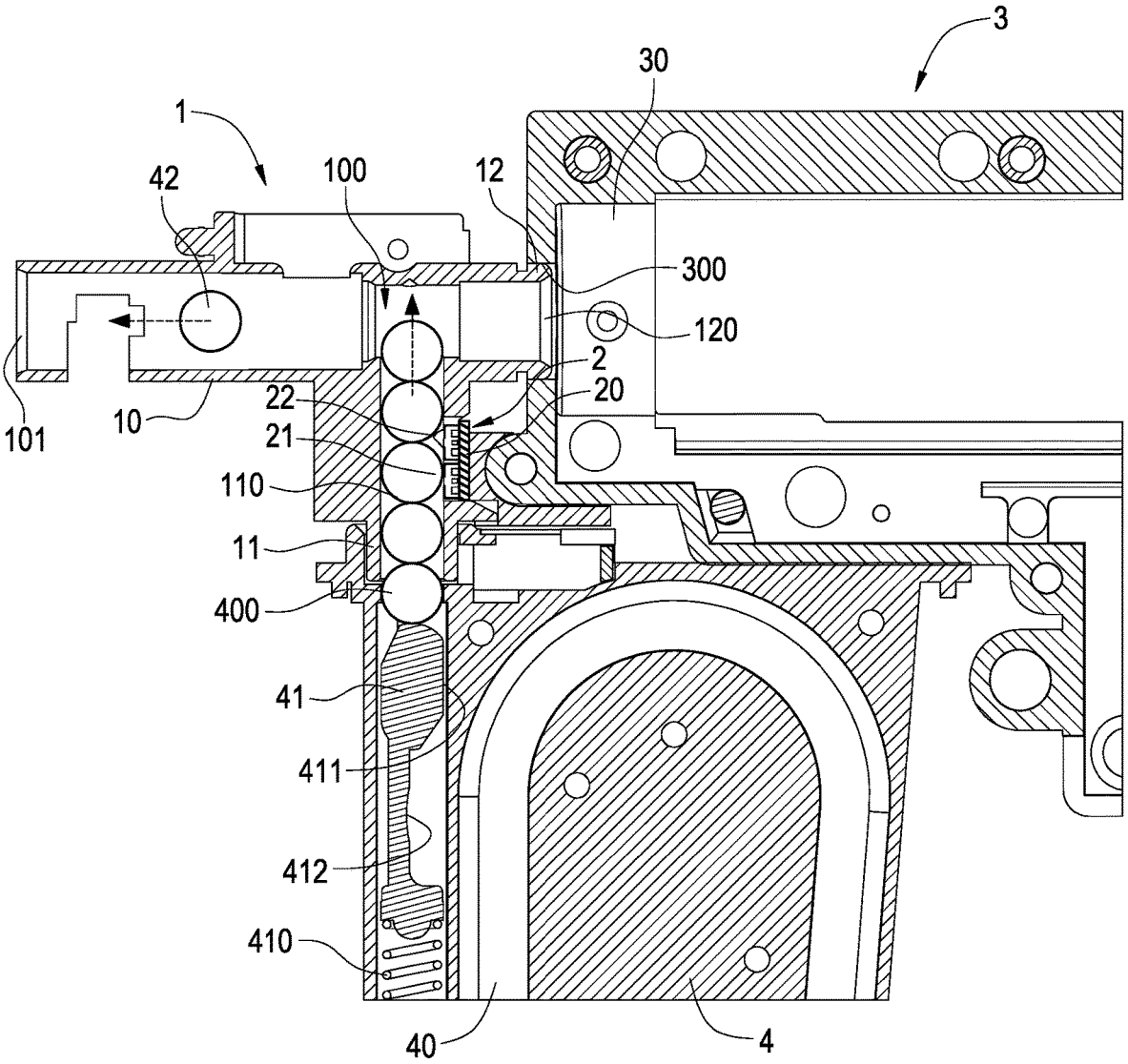
FIG. 4 is a schematic view showing a firing action with the bullet balls remaining in the magazine according to the present invention.

Please refer to FIG. 4, a ball propelling head 41 is disposed in the ball storing channel 40 of the magazine 4, and the ball propelling head 41 is able to propel bullet balls 42 in the ball storing channel 40 towards the opening 400 by utilizing a propelling spring 410, so that the bullet balls can be propelled into the ball chamber 100. Then, the ball chamber 100 is connected to a connection hole 300 of the fastening seat 30 via an end part 12 at a rear end of the ball firing pipe 10, so that the firing unit disposed in the fastening seat 30 is able to perform a firing action to the bullet ball 42 in the ball chamber 100 via a penetrated hole 120 of the end part 12, thereby allowing the fired bullet ball 42 to pass the gun barrel from the firing port 101 then to be fired to the exterior.

As shown from FIG. 1 to FIG. 3, a ball guiding channel 100 is formed in the ball feeding pipe 11, and the ball guiding channel 110 is communicated with the interior of the ball chamber 100 from the exterior portion of the bore component 11 defined at an opened end of the ball feeding pipe 11; in other words when the ball propelling head 41 of the magazine 4 is served to propel the bullet ball 42 in the ball storing channel 40 towards the opening 400, the bullet ball 42 is enabled to firstly enter the ball guiding channel 110 then to be sequentially propelled into the ball chamber 100. According to the present invention, the power source switch 2 is relatively disposed at an outer side of the ball feeding pipe 11, and the power source switch 2 has a control circuit board 20, and a first trigger part 21 and a second trigger part 22 electrically connected to the control circuit board 20 respectively, the first trigger part 21 and the second trigger part 22 are both protruded into the ball guiding channel 110, and sequentially disposed along an outward extending direction defined from the ball guiding channel 110 to the ball chamber 100. Preferably, a gap defined between the first trigger part 21 and the second trigger part 22 is substantially the same as a radius of the bullet ball 42, so that when the bullet ball 42 passes the ball guiding channel 110, only one of the bullet balls 42 is in contact with either the first trigger part 21 or the second trigger part 22 at the same time, and the first trigger part 21 and the second trigger part 22 are sequentially pressed by the passing bullet ball 42, so that situations of if any of the bullet balls 42 remaining in the magazine 4 and the bullet ball 42 being in an operated status or a firing status can be determined through signals generated by the first trigger part 21 and the second trigger part 22 being alternatively pressed.

According to another embodiment, only one of the first trigger part 21 and the second trigger part 22 is required to be disposed, so that the selected trigger part is pressed by the bullet ball 42, and a situation of whether any of the bullet balls 42 remaining in the magazine 4 can be determined through the signal of whether the selected trigger part being pressed or not.

As such, with the above-mentioned assembly, the empty-magazine power-off structure of electric toy gun is provided.

Figure 5:
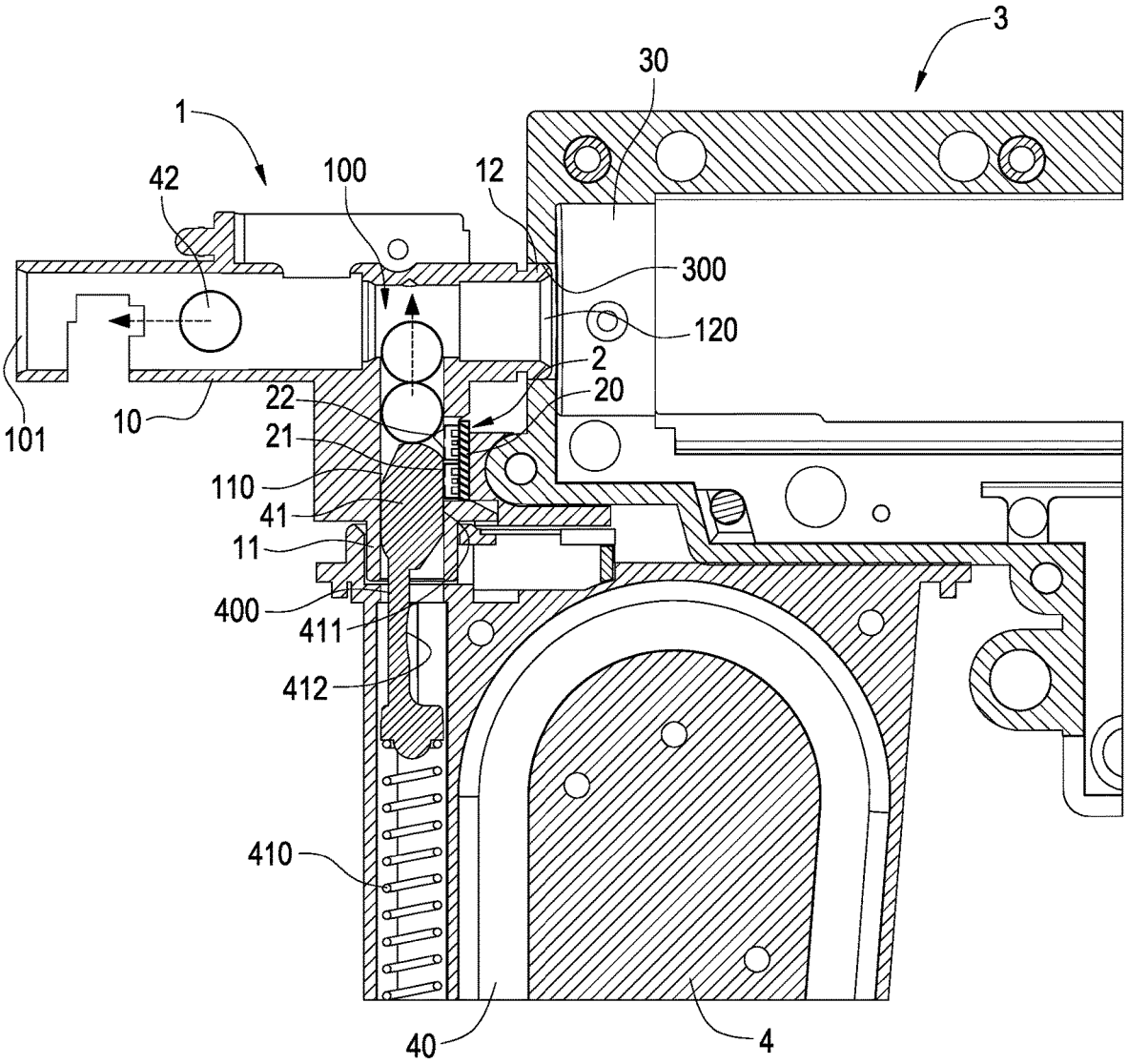
FIG. 5 is a schematic view showing the firing action with some of the bullet balls remaining in the magazine according to the present invention.
Figure 6:
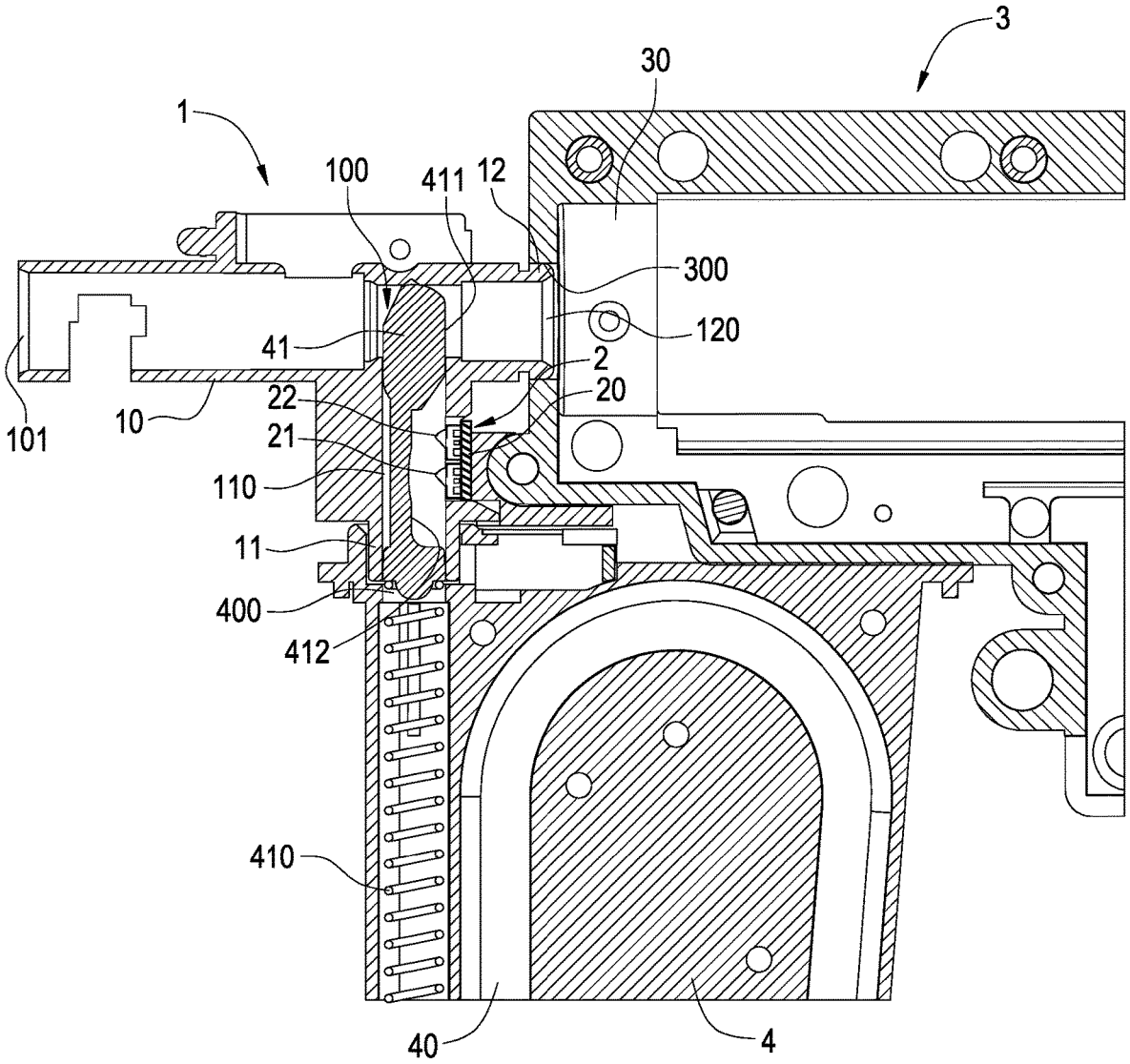
FIG. 6 is a schematic view showing the firing action with no bullet ball remaining in the magazine according to the present invention.

As shown in FIG. 4, when there is enough of the bullet balls 42 in the magazine 4, the ball propelling head 41 is served to continuously propel the bullet ball 42 into the ball chamber 100, so that the passing bullet ball 42 is able to press any of the first trigger part 21 and the second trigger part 22 of the power source switch 2, and the signal can be sent for determining whether the bullet ball 42 in the magazine 4 being continuously operated or being fired. Please refer to FIG. 5, before the bullet balls 42 in the magazine 4 are able to be operated or be completely fired, because the ball propelling head 41 has a pressing surface 411 facing the first trigger part 21 and the second trigger part 22, the pressing surface 411 is able to press the first trigger part 21 and the second trigger part 22 at the same time, thus a signal can be further provided for informing the bullet ball 42 being about to run out. Please refer to FIG. 6, when the bullet balls 42 in the magazine 4 are completely fired, the ball propelling head 41 is able to enter the ball chamber 100 or protrude into the ball chamber 100, but the ball propelling head 41 is not necessary to fully enter the ball chamber 100, the ball propelling head 41 can only partially enter or protrude into the ball chamber 100 as long as there is not enough space in the ball chamber 100 for the bullet ball 42 to be disposed, so that the ball chamber 100 can be ensured that there is no bullet ball 42 disposed therein. Moreover, the ball propelling head 41 has a granting slot 412 concavely formed at a rear end of the pressing surface 411 and facing the first trigger part 21 and the second trigger part 22, so that the granting slot 412 is able to avoid the first trigger part 21 and the second trigger part 22 and prevented from being pressed, thus a signal informing no bullet ball 42 remaining in the magazine 4 can be sent for informing the motor to stop the driving operation.

What shall be addressed is that: as long as the designed dimension is adequate, the pressing surface 411 of the ball propelling head 41 cab also be served to press the first trigger part 21 and the second trigger part 22 at the same time when there is no bullet ball 42 remaining in the magazine 4 so as to send a signal informing no bullet ball 42 remaining in the magazine 4.

Based on what has been disclosed above, the empty-magazine power-off structure of electric toy gun provided by the present invention is to disposed the empty-magazine power-off structure in a path of the bullet ball 42 travelling from the magazine 4 to the ball chamber 100 based on a conventional electric toy gun structure, so that there is no additional spaced occupied in the conventional electric toy gun, the appearance and the design of the toy gun can still follow a real gun as a model, the cost of components can be lowered, and the firing feeling provided to the user when the toy gun is in an empty-magazine power-off status can still be remained. More importantly, switches of the plurality of trigger parts or a plurality of switches can be continuously disposed according to a travelling length, and an effect and an objective of precisely determining the remaining amount of the bullet balls 42 in the magazine 4 can be achieved.

Although the present invention has been described with reference to the foregoing preferred embodiment, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. An empty-magazine power-off structure of electric toy gun, including:

a bore component, has a ball firing pipe, and a ball feeding pipe connected to the ball firing pipe, wherein a ball chamber is formed in the ball firing pipe, and the ball feeding pipe has a ball guiding channel communicated with the ball chamber from an external side; and a power source switch, relatively disposed at an outer side of the ball feeding pipe, and at least having one trigger part protruded into the ball guiding channel, wherein there are a plurality of the trigger parts disposed in the power source switch, and the trigger parts are sequentially disposed along an extending direction defined in the ball guiding channel;

wherein the ball feeding pipe is connected to a magazine, the magazine has a ball storing channel and a ball propelling head located in the ball storing channel, and the ball storing channel is formed with an opening located on the magazine so as to be used for being connected to the ball feeding pipe;

wherein the ball propelling head is able to protrude into the ball guiding channel, and has a granting slot concavely formed and facing the trigger parts.

2. The empty-magazine power-off structure of electric toy gun according to claim 1, wherein a firing port communicated with the ball chamber is formed at a front end of the ball firing pipe so as to be further connected with a gun barrel.

3. The empty-magazine power-off structure of electric toy gun according to claim 1, wherein a rear end of the ball firing pipe is connected to a gun machine.

4. The empty-magazine power-off structure of electric toy gun according to claim 1, wherein a plurality of bullet balls are stored in the ball storing channel and propelled from the ball guiding channel to the ball chamber by the ball propelling head, and only one of the bullet balls is able to press any one of the trigger parts at the same time when the plural bullet balls pass the ball guiding channel.

5. The empty-magazine power-off structure of electric toy gun according to claim 1, wherein the ball propelling head is able to protrude into the ball guiding channel, and has a pressing surface facing the trigger parts.

6. An empty-magazine power-off structure of electric toy gun, including:

a bore component, has a ball firing pipe, and a ball feeding pipe connected to the ball firing pipe, wherein a ball chamber is formed in the ball firing pipe, and the ball feeding pipe has a ball guiding channel communicated with the ball chamber from an external side; and a power source switch, relatively disposed at an outer side of the ball feeding pipe, and at least having one trigger part protruded into the ball guiding channel, wherein there are a plurality of the trigger parts disposed in the power source switch, and the trigger parts are sequentially disposed along an extending direction defined in the ball guiding channel;

wherein the ball feeding pipe is connected to a magazine, the magazine has a ball storing channel and a ball propelling head located in the ball storing channel, and the ball storing channel is formed with an opening located on the magazine so as to be used for being connected to the ball feeding pipe;

wherein the ball propelling head is able to protrude into the ball guiding channel, and has a granting slot concavely formed and facing the trigger parts;

wherein the ball propelling head has a granting slot concavely formed at a rear end of the pressing surface and facing the trigger parts.

* * * * *